US007145558B2

(12) United States Patent
Ong

(10) Patent No.: US 7,145,558 B2
(45) Date of Patent: Dec. 5, 2006

(54) SELECTIVE ILLUMINATION OF REGIONS OF AN ELECTRONIC DISPLAY

(75) Inventor: Dee Nai Ong, Singapore (SG)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/654,290

(22) Filed: Sep. 3, 2003

(65) Prior Publication Data

US 2005/0057539 A1 Mar. 17, 2005

(51) Int. Cl.
*G09G 5/00* (2006.01)

(52) U.S. Cl. ..... 345/204; 345/211; 345/207

(58) Field of Classification Search ..... 345/204, 345/102, 207, 76–89, 211; 349/24, 113; 347/14, 19, 23; 340/436, 502, 438; 455/550–575; 348/229.1; 315/291; 715/794; 358/1.15; 250/591

See application file for complete search history.

(56) References Cited

U.S. PATENT DOCUMENTS 3,786,582 A * 1/1974 Ralbowsky ..... 40/471
4,973,149 A * 11/1990 Hutchinson ..... 351/210
5,796,382 A * 8/1998 Beeteson ..... 345/102
5,881,377 A * 3/1999 Giel et al. ..... 455/343.1
5,900,873 A * 5/1999 Isoda et al. ..... 715/794
5,994,713 A * 11/1999 Becker et al. ..... 250/591
6,035,180 A * 3/2000 Kubes et al. ..... 455/575.1
6,140,987 A * 10/2000 Stein et al. ..... 345/87
6,175,353 B1 * 1/2001 Hoeksma ..... 345/102
6,219,021 B1 4/2001 Izumi
6,269,565 B1 * 8/2001 Inbar et al. ..... 40/361
6,378,977 B1 * 4/2002 Gompertz ..... 347/19
6,400,099 B1 * 6/2002 Walker ..... 315/291
6,448,951 B1 * 9/2002 Sakaguchi et al. ..... 345/88
6,690,268 B1 * 2/2004 Schofield et al. ..... 340/438
6,696,931 B1 * 2/2004 Paranjpe ..... 340/436
6,791,643 B1 * 9/2004 Chuang ..... 349/113
6,862,012 B1 * 3/2005 Funakoshi et al. ..... 345/88
6,999,052 B1 * 2/2006 Pfeiffer et al. ..... 345/89
2002/0041280 A1 4/2002 Woo
2003/0058211 A1 * 3/2003 Kim et al. ..... 345/89
2003/0123085 A1 * 7/2003 Kato ..... 358/1.15
2003/0179323 A1 * 9/2003 Abileah et al. ..... 349/24
2004/0072589 A1 * 4/2004 Hamamura et al. ..... 455/550.1
2004/0201730 A1 * 10/2004 Tamura ..... 348/229.1
2004/0204014 A1 * 10/2004 Colorado ..... 455/550.1
2005/0026657 A1 * 2/2005 Hasegawa et al. ..... 455/566
2006/0100002 A1 * 5/2006 Luebke et al. ..... 455/574

* cited by examiner

*Primary Examiner*—Bipin Shalwala
*Assistant Examiner*—Prabodh Dharia
(74) *Attorney, Agent, or Firm*—Randall S. Vaas

(57) ABSTRACT

An electronic device (1) provides for the selective illuminating of an associated display (5) thereby reducing battery power consumption. The electronic device (1) provides for detecting an event that will trigger an update of the display (5) and activation of illumination elements (27) for illuminating the display and determining whether the information to be displayed will occupy a region (B–L) of the display. If so, the region of the display is selectively illuminated by one or more of the illumination elements. The predetermined illumination time period may depend on a selected combination of a size of the region, a location of said region and/or a priority associated with the event.

22 Claims, 7 Drawing Sheets

37

| DISPLAY REGION | ACTIVATED ILLUMINATION ELEMENTS | ILLUMINATED AREA | ILLUMINATION TIME PERIOD |
|---|---|---|---|
| A | ALL (L1,L2,R1,R2,U1,U2,B1 & B2) | ENTIRE DISPLAY AREA | Z SECONDS (E.G. 15 SEC) |
| B | L1,R1,U1 & U2 | UPPER HALF | Y (E.G. 8 SEC; GENERALLY Y<Z) |
| C | L2,R2,B1 & B2 | BOTTOM HALF | Y (GENERALLY Y<Z) |
| D | L1,L2,R1 & R2 | CENTRAL AREA | X (E.G. 10 SEC; GENERALLY Y<X<Z) |
| E | L1& L2 | LEFT HALF | W (RELATIVELY SHORT DURATION, E.G.3-4 SEC) |
| F | R1 & R2 | RIGHT HALF | W (RELATIVELY SHORT DURATION, E.G.3-4 SEC) |
| G | U1 & U2 | TOP FRINGE | V (GENERALLY SHORT DURATION, E.G.2-3 SEC) |
| H | B1 & B2 | BOTTOM FRINGE | V (GENERALLY SHORT DURATION, E.G.2-3 SEC) |
| I | U1 & L1 | UPPER LEFT CORNER | U (GENERALLY SHORT DURATION, E.G.2-3 SEC) |
| J | U2 & R1 | LOWER RIGHT CORNER | U (GENERALLY SHORT DURATION, E.G.2-3 SEC) |
| K | B1 & L2 | LOWER LEFT CORNER | U (GENERALLY SHORT DURATION, E.G.2-3 SEC) |
| L | B2 & R2 | LOWER RIGHT CORNER | U (GENERALLY SHORT DURATION, E.G.2-3 SEC) |

*FIG. 4*

SELECTIVE ILLUMINATION OF REGIONS OF AN ELECTRONIC DISPLAY

FIELD OF THE INVENTION

The invention relates to selective illumination of regions of a display for an electronic device. In particular, although not exclusively, the invention is particularly useful for reducing battery power consumption in portable electronic devices caused by illuminating displays.

BACKGROUND ART OF THE INVENTION

Nowadays, many portable electronic devices such as handheld computers, personal digital assistants (PDAs) and mobile telecommunication devices such as radio telephones comprise colour displays, often in the form of liquid crystal displays (LCDs). Such colour displays are becoming commonplace and are likely to supersede black and white and grey-scale displays.

However, one problem with the colour displays is that they generally drain a higher current from the battery than the black and white and grey-scale counterparts, thus reducing the battery life.

Another problem associated with colour displays is concerned with the illumination of the displays. Unlike the black and white and grey-scale displays, the colour displays can only be viewed clearly and comfortably with the display backlight switched on. In the absence of illumination provided by the backlight, the display can be difficult to read and the displayed colours do not look appealing. Furthermore, illumination of colour displays is not only required in dark environments, but in normal daylight conditions.

On some portable electronic devices it is possible for the user to set a backlight timeout period or a backlight illumination duration. Therefore, since colour displays require backlight illumination for comfortable and appealing viewing, the user can set the backlight illumination duration or backlight timeout period to a duration that is sufficient to view the information being displayed.

However, for many portable electronic devices, such as radio telephones, it is not possible for the user to set the backlight timeout period or backlight illumination duration. Instead, the backlight timeout period or backlight illumination duration will be configured upon manufacture of the device and will be applied to all backlight on states of the display irrespective of the information being displayed. This is usually done for design simplicity and consistency. Because of the variation in type and volume of information that may be displayed, the predetermined backlight illumination duration corresponds to an average time required to view the displayed information. Consequently, the illumination duration is often unnecessarily long when viewing colour displays comprising minimal information, such as idle screens or short text messages, resulting in unnecessary and undesirable reduction in battery life.

One attempt to address this problem involves incorporating a count module in portable electronic devices that counts the number of characters to be displayed. An illumination control module adjusts the duration of the illumination provided by the backlight according to the number of characters by referring to an illumination period look-up table. For example, if between 1 and 100 characters are to be displayed, illumination may be provided by the backlight for 30 seconds. If between 101 and 150 characters are to be displayed, illumination may be provided by the backlight for 45 seconds. The look-up table also comprises pre-set illumination periods that are dependent on the application in use on the portable electronic device. For example, if the device is being used for a telephone call, the backlight illumination period may be 30 seconds. If the device is being used for a memo application, the backlight illumination period may be 45 seconds. The backlight illumination period may also be pre-set according to both the number of characters displayed and the application in use.

Although the aforementioned character count dependent and/or application dependent illumination period schemes reduce some unnecessary battery usage, these schemes are not sensitive to the importance or otherwise of the information being displayed. For example, if the illumination period depends on the number of displayed characters and a short, but important message is displayed, such as a missed call message, the display may only be illuminated for a short period resulting in the missed call message being overlooked. Similarly, if the device is in use for an application for which the pre-set illumination period is relatively short, and important information is displayed, such as an incoming message icon, the illumination period may be insufficient to attract a user's attention to the important information. Hence, the backlight illumination periods of these schemes do not take into account the context of the information displayed.

Another deficiency in the illumination of displays of portable electronic devices such as radio telephones is that once backlight illumination is required, all of the illumination elements employed for illumination, which are often light emitting diodes (LEDs), are activated and the entire display is illuminated, even if there is only a small amount of information, such as an icon or a short text message, to be viewed. This also results in unnecessary and undesirable reduction in battery life, particularly with a current trend towards larger display screens in portable electronic devices.

Accordingly, there exists a need for one or more backlight illumination methods for illuminating the displays of portable electronic devices that are considerate of the type and volume of information being displayed and which conserve battery life.

In this specification, including the claims, the terms "comprises", "comprising" or similar terms are intended to mean a non-exclusive inclusion, such that a method or apparatus that comprises a list of elements does not include those elements solely, but may well include other elements not listed.

SUMMARY OF THE INVENTION

According to one aspect of the invention there is provided a method for selectively illuminating regions of a display of a portable electronic device, the display comprising a plurality of illuminating regions, said method including:

- detecting an event that will trigger an update of said display and activation of illumination elements for illuminating said display;
- determining at least one region, from said regions, that require illuminating during said update; and
- selectively illuminating at least one of said region of said display.

Suitably the determining may include referring to a mapping table to determine said illumination elements to be activated to selectively illuminate said region of said display.

Preferably, the determining may include referring to a mapping table to identify a predetermined illumination time period.

The predetermined illumination time period may depend on a size of said region. However, the predetermined illumination time period may depend on a location of said region in said display.

Preferably, smaller regions may illuminated for shorter predetermined time periods than larger regions.

The method may further include the step of referring to said mapping table to determine a priority of said event and applying said predetermined illumination time period in accordance with said priority of said event.

Said predetermined illumination time period may be determined according to a selected combination of said size of said region, said location of said region and/or said priority of said event.

The method may further include the step of referring to said mapping table to determine a priority of said event and applying an illumination brightness in accordance with said priority of said event.

The step of selectively illuminating said region of said display may include activating one or more of said illumination elements adjacent at least one side of said display to illuminate a side region of said display.

The step of selectively illuminating said region of said display may include activating one or more of said illumination elements adjacent opposing sides of said display to illuminate a substantially central region of said display.

The step of selectively illuminating said region of said display may include activating a selected combination of said illumination elements to illuminate a selected region of said display.

The step of selectively illuminating said region of said display may include activating said illumination elements illuminating said region to a first brightness and activating a remainder of said illumination elements to a second brightness.

The step of selectively illuminating said region of said display may include one or more of said illumination elements alternating between an activated state and deactivated or partially activated state to produce flashing illumination.

According to another aspect of the invention, there is provided a portable electronic device comprising:

a display for displaying information;

a plurality of illumination elements located adjacent said display for illuminating said display;

a display handling module coupled to said display for:

i) updating said display in response to said device detecting an event that will trigger an update of said display and activation of said illumination elements; and ii) determining a region of said display in which said information will be displayed during said update; and, an illumination control module coupled to said display handling module for controlling selective illumination of said region.

The portable electronic device may further comprise an illumination driver coupled to said illumination control module and to said illumination elements for controlling activation and deactivation of said illumination elements in response to signals from said illumination control module.

The portable electronic device may further comprise a mapping table to which said display handling module and said illumination control module refer, said mapping table comprising identities of said illumination elements to be activated to selectively illuminate said regions.

Preferably, said mapping table comprises a predetermined illumination time period for each said region.

Suitably, said mapping table comprises a priority associated with each said event and a predetermined illumination time period associated with each said priority.

Suitably, said mapping table comprises a predetermined illumination brightness associated with said priority of each said event.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein:

FIG. 4 is a mapping table of illumination regions of the display of FIG. 2, associated illumination elements and predetermined illumination time periods;

DETAILED DESCRIPTION OF THE PREFERRED EMBODIMENT OF THE INVENTION

Figure 1:
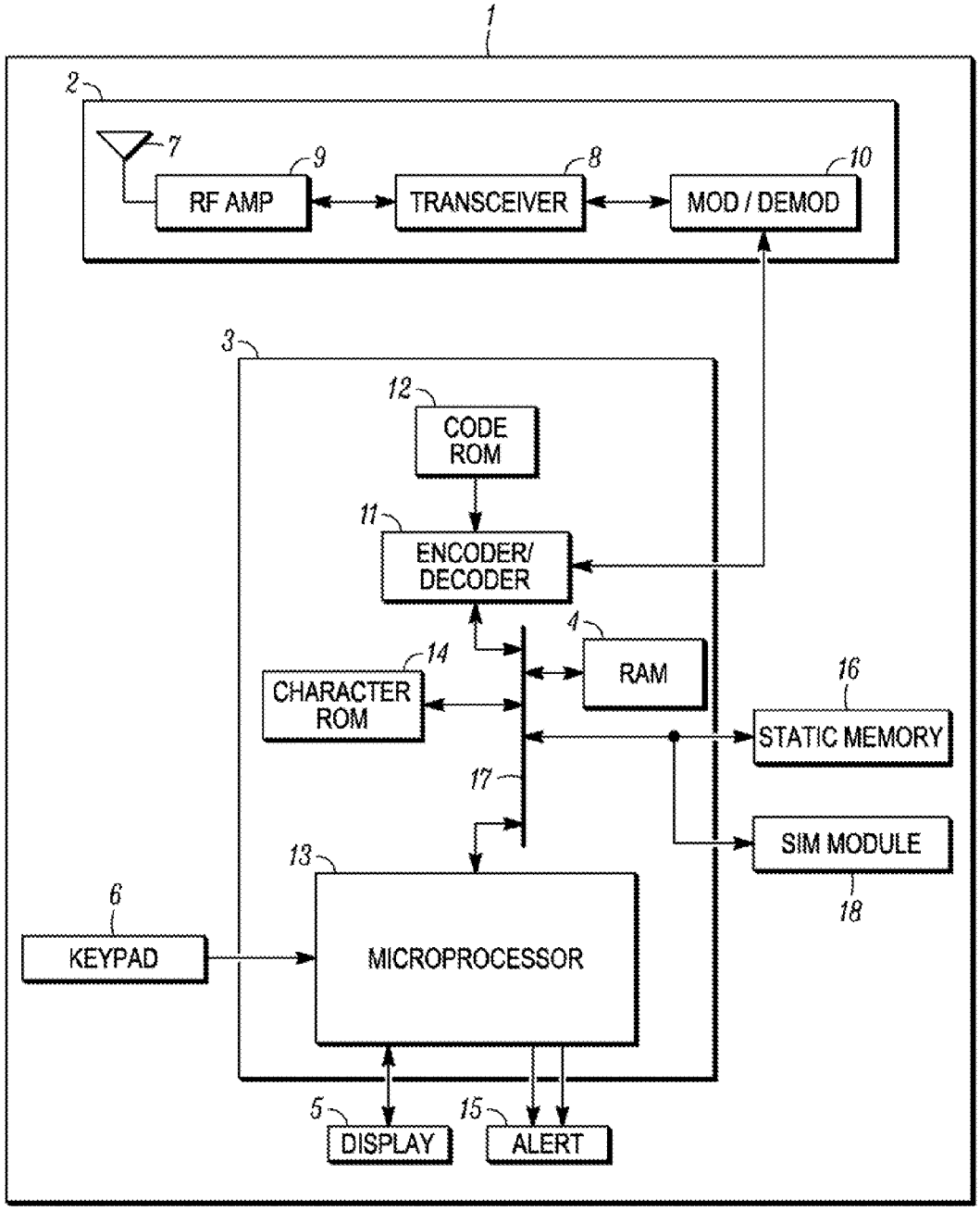
FIG. 1 shows a block diagram of a typical radio telephone in which the present invention may be employed.

In the drawings, like numerals on different FIGS are used to indicate like elements throughout.

With reference to FIG. 1, there is illustrated a portable electronic device in the form of a radio telephone 1 comprising a radio frequency communications unit 2 coupled to be in communication with a processor 3. An input interface in the form of a display 5 and a keypad 6 are also coupled to be in communication with the processor 3.

The processor 3 includes an encoder/decoder 11 with an associated Read Only Memory (ROM) 12 storing data for encoding and decoding voice or other signals that may be transmitted or received by the radio telephone 1. The processor 3 also includes a micro-processor 13 coupled, by a common data and address bus 17, to the encoder/decoder 11 and an associated character Read Only Memory (ROM) 14, a Random Access Memory (RAM) 4, static programmable memory 16 and a removable SIM module 18. The static programmable memory 16 and SIM module 18 each can store, amongst other things, selected incoming text messages and a telephone book database TDb.

The micro-processor 13 has ports for coupling to the keypad 6, the display 5 and an alert module 15 that typically contains a speaker, vibrator motor and associated drivers. The character Read Only Memory 14 stores code for decoding or encoding text messages that may be received by the communication unit 2, input at the keypad 6. In this embodiment the character Read Only Memory 14 also stores operating code (OC) for micro-processor 13 and code for performing the methods as described below with reference to FIGS. 2–7.

The radio frequency communications unit 2 is a combined receiver and transmitter having a common antenna 7. The communications unit 2 has a transceiver 8 coupled to antenna 7 via a radio frequency amplifier 9. The transceiver 8 is also coupled to a combined modulator/demodulator 10 that couples the communications unit 2 to the processor 3.

Figure 2:
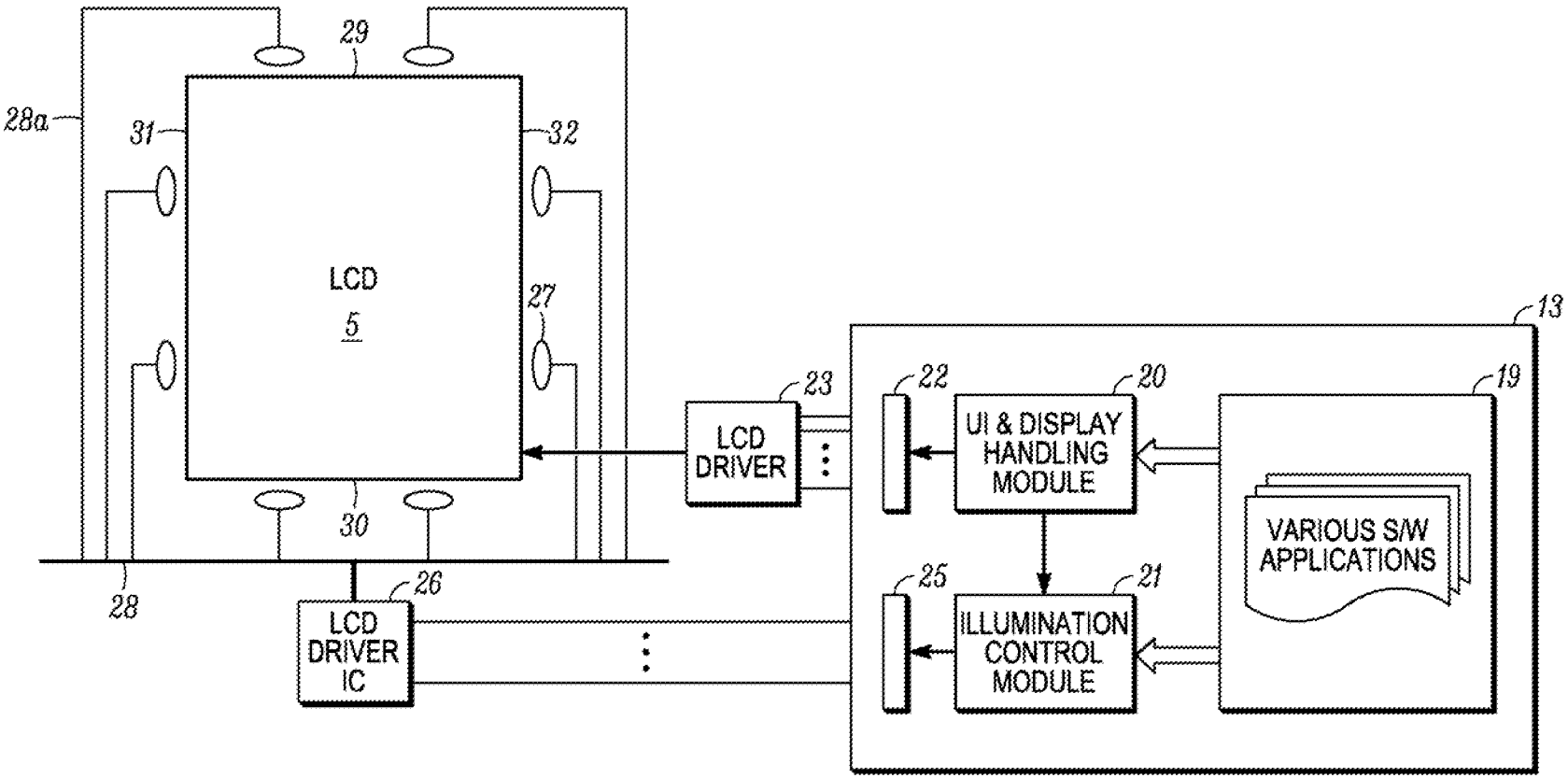
FIG. 2 shows further elements of a display shown in FIG. 1 and elements for controlling the display.

With reference to FIG. 2, micro-processor 13 executes various software applications 19, such as call applications, alarm/reminder applications and short message service (SMS) applications. The software applications 19 are coupled to be in communication with a user interface (UI) and display handling module 20 and illumination control module 21. The UI and display handling module 20 is also coupled to be in communication with illumination control module 21.

The UI and display handling module 20 is coupled via a port 22 of the micro-processor 13 to a display driver in the form of liquid crystal display (LCD) driver 23. The LCD driver 23 is coupled to the display 5 and controls activation and deactivation of the display 5 for the presentation of information on the display 5. The illumination control module 21 is coupled via a port 25 of the micro-processor 13 to an illumination element driver in the form of LED driver integrated circuit (IC) 26. The LED driver IC 26 is coupled to illuminating elements 27 in the form of LEDs via a control signal bus 28 and control signal lines 28*a*.

Figure 3C:
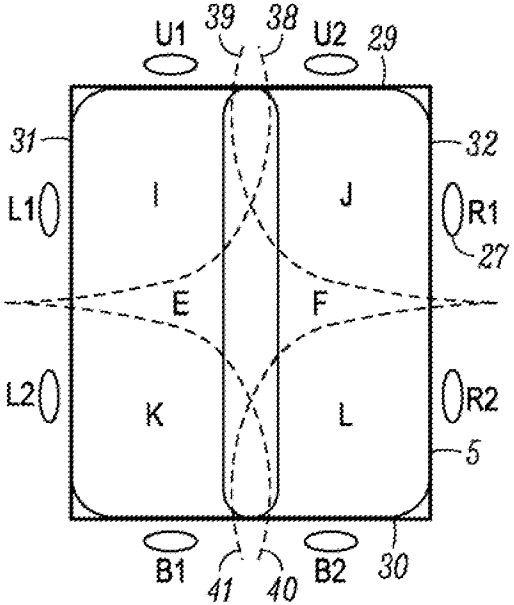
FIG. 3C shows a third set of methods for selectively illuminating regions of the display of FIG. 2.
Figure 3B:
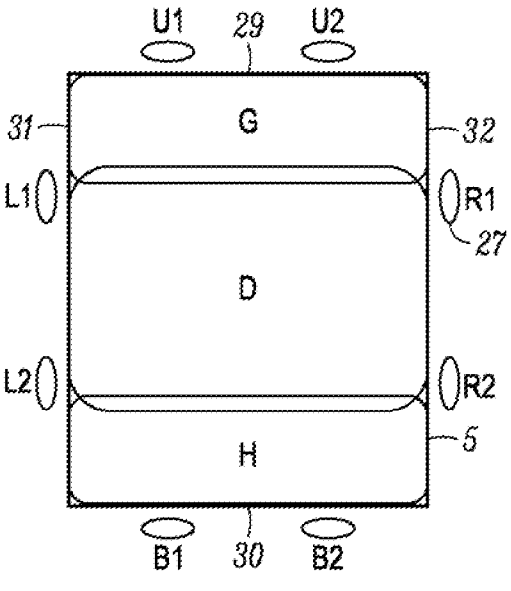
FIG. 3B shows a second set of methods for selectively illuminating regions of the display of FIG. 2.
Figure 3A:
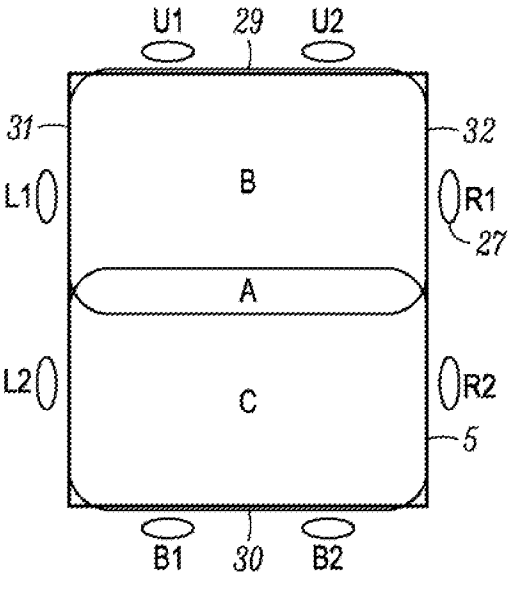
FIG. 3A shows a first set of methods for selectively illuminating regions of the display of FIG. 2.

With reference to FIGS. 3A–3C, in one embodiment there are provided two illuminating elements 27 in the form of LEDs U1, U2 adjacent the top 29 of the display 5, two illuminating elements 27 in the form of LEDs B1, B2 adjacent the bottom 30 of the display 5, two illuminating elements 27 in the form of LEDs L1, L2 adjacent the left 31 of the display 5 and two illuminating elements 27 in the form of LEDs R1, R2 adjacent the right 32 of the display 5. Each illuminating element 27 provides backlighting for the display 5 and each illuminating element 27 may be individually activated and deactivated.

With reference to the mapping table 37 shown in FIG. 4, as with conventional portable electronic devices, the entire display area, labelled area A, of the display 5 may be illuminated by activating all of the illumination elements 27 adjacent the display 5. The entire area A may be illuminated for a predetermined time period Z of, for example, 15 seconds.

However, in accordance with the present invention, FIGS. 3A–3C show a number of different methods for selectively illuminating a region of the display 5, which will now be described with further reference to the mapping table 37 shown in FIG. 4.

With reference to FIG. 3A, the activation by LED driver IC 26 of LEDs L1, R1, U1 and U2 selectively illuminates a substantially upper half of the display 5 identified as region B. Similarly, activation by LED driver IC 26 of LEDs L2, R2, B1 and B2 selectively illuminates a substantially lower half of the display 5 shown as region C. Regions B and C may each be illuminated for a predetermined time period Y of, for example, 8 seconds. The illumination period Y is shorter than period Z for area A because of the size of regions B and C relative to area A. There is likely to be less information in smaller regions B and C than in larger area A, thus requiring less viewing time and therefore a shorter illumination time period.

With reference to FIG. 3B, the activation by LED driver IC 26 of LEDs L1, L2, R1 and R2 selectively illuminates a substantially central region of the display 5 labelled region D. Central region D may be illuminated for a predetermined time period X of, for example, 10 seconds. The illumination period X is shorter than illumination period Z for area A, but longer than period Y for regions B and C because region D is smaller than area A, but larger than regions B and C.

Activation by LED driver IC 26 of LEDs U1 and U2 selectively illuminates substantially an upper fringe of the display 5 identified as region G. Similarly, activation by LED driver IC 26 of LEDs B1 and B2 selectively illuminates substantially a lower fringe of the display 5 identified as region H. Regions G and H may each be illuminated for a predetermined time period V of, for example, 2–3 seconds. The illumination period V is generally short because regions G and H are small in comparison with, for example, regions B and C and the small amount of information that can be contained in regions G and H is likely to only require a short period of time to view.

With reference to FIG. 3C, the activation by LED driver IC 26 of LEDs L1 and L2 selectively illuminates substantially a left half of the display 5 labelled region E. Similarly, activation by LED driver IC 26 of LEDs R1 and R2 selectively illuminates substantially a right half of the display 5 identified as region F. Regions E and F may each be illuminated for a predetermined time period W of, for example, 3–4 seconds. The illumination period W is shorter than that of regions A–D, but longer than that of regions G and H because more information can be displayed in regions E and F than in regions G and H, hence requiring a longer viewing period.

FIG. 3C also illustrates selective illumination of corner regions of the display 5. Activation of LEDs U1 and L1 by LED driver IC 26 selectively illuminates substantially an upper left corner region of the display 5, which is identified as region I and approximately demarcated by dotted line 38. Activation by LED driver IC 26 of LEDs U2 and R1 selectively illuminates substantially an upper right corner of the display 5, which is identified as region J and approximately demarcated by dotted line 39. Similarly, activation by LED driver IC 26 of LEDs L2 and B1 selectively illuminates substantially a lower left corner of the display 5, which is identified as region K and approximately demarcated by dotted line 40. Activation by LED driver IC 26 of LEDs R2 and B2 selectively illuminates substantially a lower right corner of the display 5, which is identified as region L and approximately demarcated by dotted line 41. Regions I, J, K and L may each be illuminated for a predetermined time period U of, for example, 2–3 seconds. The illumination time period U is generally short in view of the small amount of information that can be displayed in regions 1, J, K and L.

A method for selectively illuminating regions of the display 5 will now be described with reference to the flowchart shown in FIG. 5. With reference to step 100 in FIG. 5, initially a portable electronic device, such as radio telephone 1 shown in FIG. 1, may be in a state, such as an idle state, where none of the illumination elements 27 are activated and therefore the display 5 is not illuminated.

With reference to step 101, in the absence of an event that would trigger the display 5 to be updated and require illumination of the display, the display remains in a non-illuminated state. However, if an event is detected by the radio telephone 1 that will trigger an update of the display and trigger illumination of the display, such as an incoming call, a reminder, an incoming text message or a key-press or the like, a check is made to verify whether an reduced battery power consumption illumination control method of the present invention is enabled, as represented by step 102. If it is not enabled, all of the illuminating elements 27 are activated by the illumination control module 21 via the LED driver IC 26 in response to the event and the entire display 5 is illuminated, as represented by step 103. And the method the ends.

If the reduced battery power consumption illumination control method of the present invention is enabled, step 104 of the method includes verifying whether or not the region of the display comprising the information to be viewed occupies one of the regions (B to L) of the display 5 as described above with reference to the mapping table 37. If not, e.g. if the information to be viewed occupies substantially the entire area of the display 5 (e.g. region A), all of the illuminating elements 27 are activated as represented by step 103, to enable all of the information to be clearly viewed.

However, if the information to be viewed occupies a region of the display 5, with reference to step 105 of the method, the UI and display handling module 20 determines at least one appropriate region (B–L) of the display 5 that requires illuminating during the update, by the illumination elements 27, by referring to the mapping table 37 shown in FIG. 4. For example, if the information to be displayed and viewed occupies substantially the upper half of the display 5, the UI and display handling module 20 determines with reference to the mapping table of FIG. 4 that this corresponds to region B of the display 5 shown in FIG. 3A. The UI and display handling module 20 then inputs the location of the region of the display 5 to be illuminated to the illumination control module 21.

Figure 5:
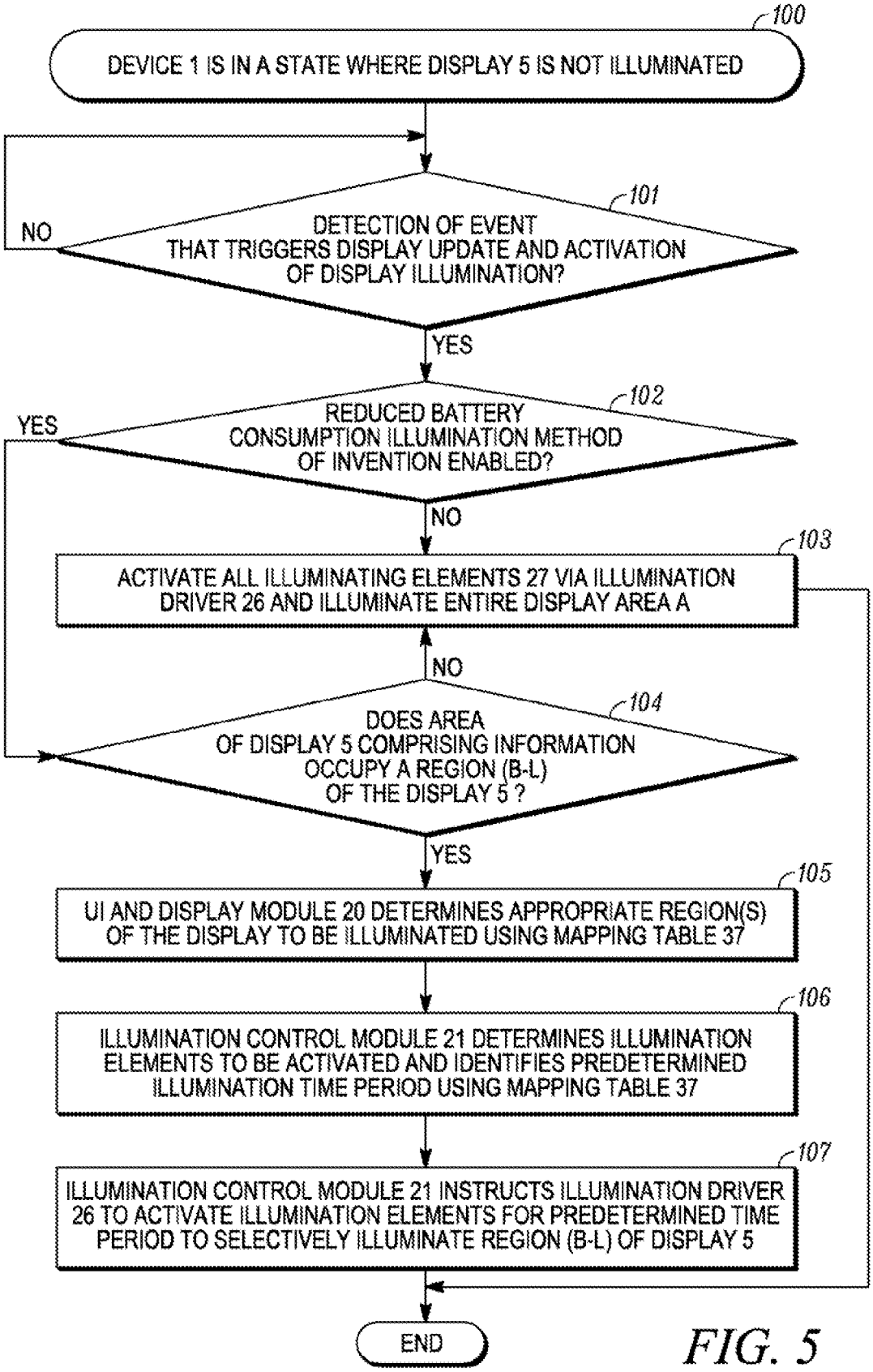
FIG. 5 is a flow chart representing the steps of selectively illuminating regions of the display of FIG. 2.

With reference to step 106 in FIG. 5, based on the location of the region received from the UI and display handling module 20, the illumination control module 21 determines the illumination elements 27 to be activated and identifies the predetermined illumination time period with reference to the mapping table 37 of FIG. 4.

Referring to step 107, the illumination control module 21 instructs the LED driver IC 26 which illumination elements 27 to activate and communicates the predetermined illumination time period. The LED driver IC 26 then activates the illumination elements 27 in accordance with the instructions from the illumination control module 21 to selectively illuminate the region (or possibly regions) of the display 5 comprising the information to be viewed.

Two specific examples of selective illumination of a region of the display 5 in a radio telephone 1 in accordance with the present invention will now be described with reference to FIGS. 6 and 7.

Figure 6:
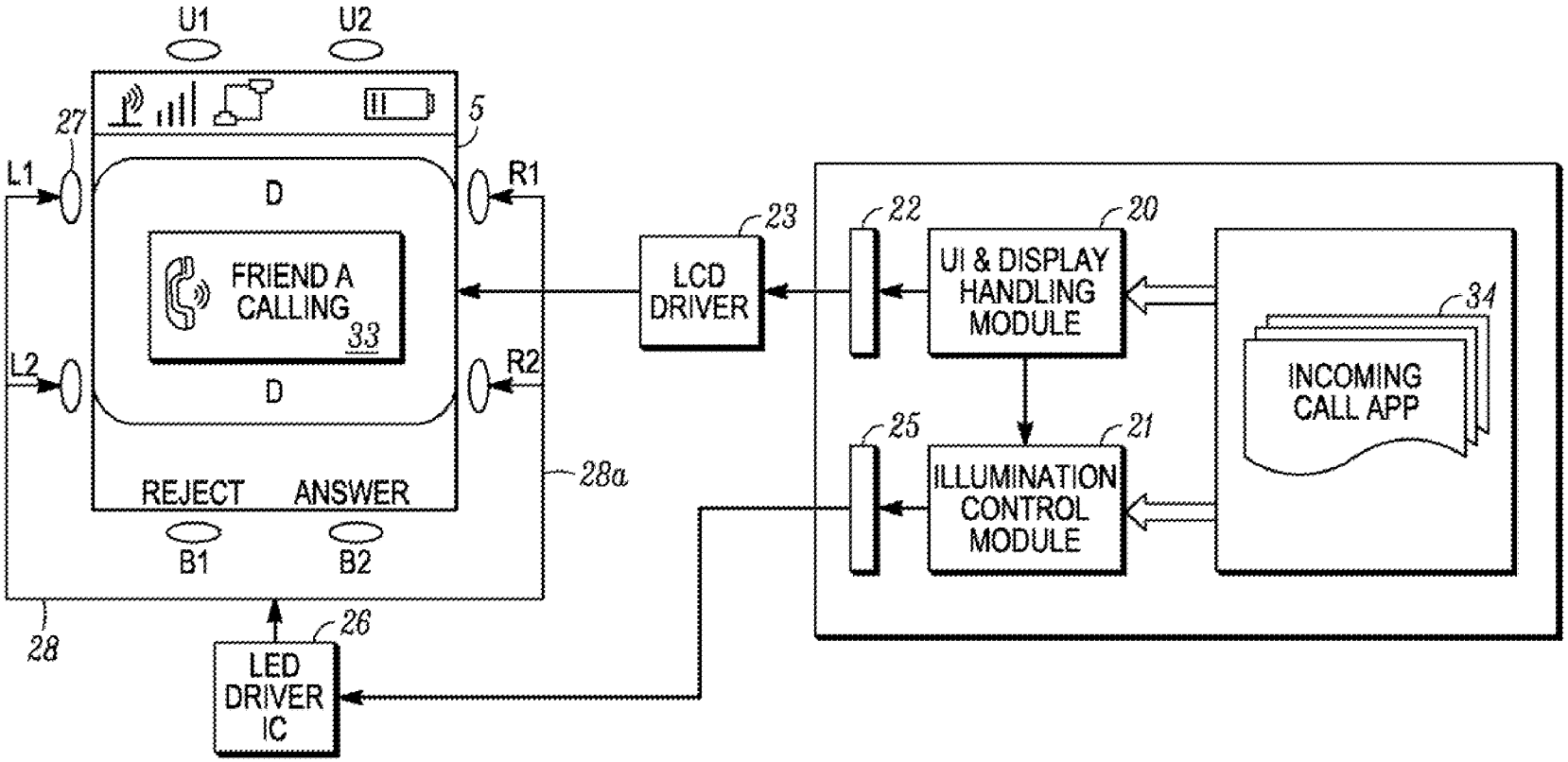
FIG. 6 shows a first example of selectively illuminating a region of the display of FIG. 2.

With reference to the example shown in FIG. 6, an incoming call signal is detected by the common antenna 7, which results in a software application 19 in the form of an incoming call application 34 being retrieved from the character ROM 14 and executed by the micro-processor 13. Incoming call application 34 instructs the UI and display handling module 20 to update the display 5 via LCD driver 23 to display a dialogue box 33 in a central region D of the display 5. The dialogue box 33 indicates that there is an incoming call and indicates the identity of the caller. The UI and display handling module 20 determines the region of the display 5 in which the information will be displayed. The UI and display handling module 20 informs the illumination control module 21 of the region of the display 5 that will comprise the information to be viewed, i.e. the dialogue box 33. In this example, the region to be viewed is the substantially central region corresponding to region D.

Based on the location of the region received from the UI and display handling module 20, the illumination control module 21 determines the illumination elements 27 to be activated and identifies the predetermined illumination time period from the mapping table 37 shown in FIG. 4. The predetermined illumination time period X for period D is 10 seconds, as specified in FIG. 4.

The illumination control module 21 sends one or more signals to the LED driver IC 26 to activate the relevant illumination elements 27 for the predetermined time period. In this example, and with reference to the mapping table in FIG. 4, the illumination elements that need to be activated to selectively illuminate the central region are LEDs L1, L2, R1 and R2. LED driver 26 then activates LEDs L1, L2, R1 and R2 via control signal bus 28 and control signal lines 28*a*. FIG. 6 shows LEDs L1, L2, R1 and R2 in an activated state to illuminate the substantially central region D comprising the information to be viewed. The remaining LEDs, U1, U2, B1 and B2 may not be activated and so switched off such that upper and lower fringes of the display 5 denoted as regions G and H respectively, as shown in FIG. 3B, are not illuminated. Alternatively, the remaining LEDs, U1, U2, B1 and B2 may be partially driven by the LED driver 26 such that they are activated, but have a brightness that is less than the brightness of LEDs L1, L2, R1 and R2. For example, a second brightness of the illumination provided by LEDs, U1, U2, B1 and B2 may be half of a first brightness provided by LEDs L1, L2, R1 and R2. Preferably, LEDs, U1, U2, B1 and B2 are not activated to reduced battery power consumption.

Figure 7:
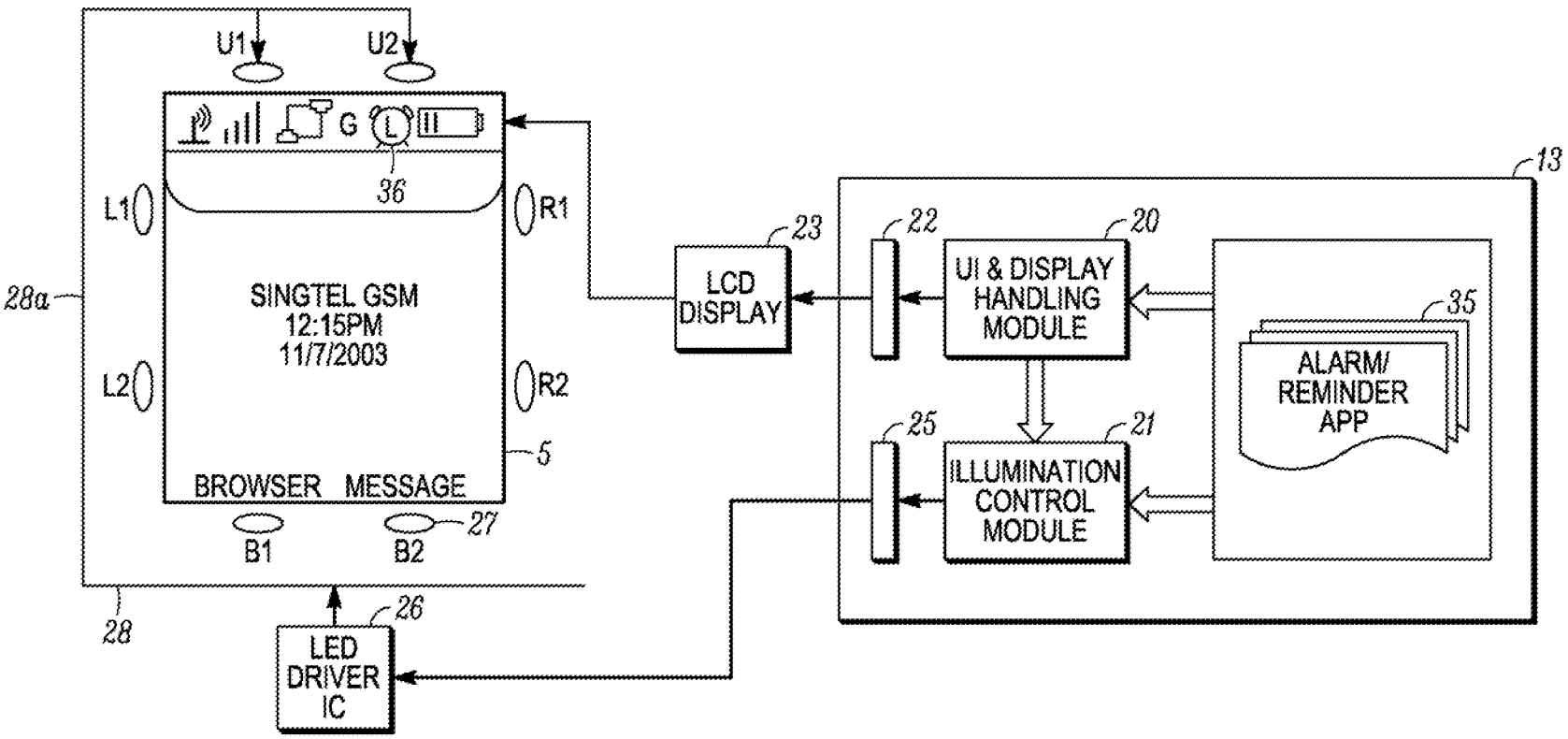
FIG. 7 shows a second example of selectively illuminating a region of the display of FIG. 2.

With reference to the example shown in FIG. 7, if an alarm/reminder has been set on the portable electronic device, at the predetermined alarm/reminder time a software application 19 in the form of an alarm/reminder application 35 will be retrieved from the character ROM 14 for execution by the micro-processor 13. Alarm/reminder application 35 instructs the UI and display handling module 20 to update the display 5 via LCD driver 23 to display an alarm/reminder icon 36 in the upper fringe of the display 5. The UI and display handling module 20 informs the illumination control module 21 of the region of the display 5 that comprises the information to be viewed, i.e. the alarm/reminder icon 36. In this example, the region to be viewed is the upper fringe corresponding to region G.

The illumination control module 21 then determines the illumination elements 27 that need to be activated to selectively illuminate region G and identifies the predetermined illumination time period from the mapping table 37 of FIG. 4. For region G, the predetermined illumination time period V is between 2–3 seconds.

The illumination control module 21 sends one or more signals to the LED driver IC 26 to selectively activate the relevant illumination elements 27 for the predetermined time period. In this example, and with reference to the mapping table 37 in FIG. 4, the illumination elements that need to be activated to illuminate the upper fringe are LEDs U1 and U2. LED driver 26 then activates LEDs U1 and U2 via control signal bus 28 and control signal lines 28*a*. FIG. 7 shows LEDs U1 and U2 in an activated state to illuminate the upper fringe region G comprising the information to be viewed. The remaining LEDs, L1, L2, R1, R2, B1 and B2 may not be activated and so switched off such that central region D and lower fringe region H of the display 5 are not illuminated. Alternatively, LEDs, L1, L2, R1, R2, B1 and B2 may be partially driven by the LED driver 26 such that they are activated, but have a second brightness that is less than a first brightness of LEDs U1 and U2. Preferably, LEDs, L1, L2, R1, R2, B1 and B2 are not activated to reduced battery power consumption.

In accordance with another method of selective illumination control for reduced battery power consumption of the present invention, the predetermined illumination time periods may be varied from those shown in the mapping table 37 of FIG. 4 depending on a priority of the event that will trigger an update of the display 5 and activation of illumination elements 27 for illuminating the display.

According to one embodiment, each event of which the portable electronic device is capable, may have an associated priority and the priority of each event may be stored in the mapping table 37 of FIG. 4. For example, an alarm/reminder event may have a higher associated priority than, for example, the event of receiving a text message that would involve displaying a received text message icon. Similarly, the event of an incoming call may have a higher associated priority than that of the alarm/reminder event. Each event priority may have an associated predetermined illumination time period such that events with a higher priority are illuminated for longer periods than events with a lower priority. Alternatively, events may be grouped together and a priority associated with the group of events.

For example, in the scenario described above in relation to FIG. 7 wherein an alarm/reminder icon 36 is displayed in region G of the display 5 that is illuminated for 2–3 seconds, it may be desirable to illuminate the alarm/reminder icon 36 for a longer predetermined time period to ensure that a user's attention is brought to the alarm/reminder. Therefore, mapping table 37 may be referred to to determine the priority of the event. If the priority is relatively high, but the event is occurring in a region for which the illumination period is generally or relatively short, the illumination time period may be increased in accordance with the priority of the event. In the scenario shown in FIG. 7, the illumination time period may be increased from 2–3 seconds to, for example, 5–6 seconds, which may be the predetermined illumination time period associated with the priority of the alarm/reminder event. Hence, although region G is small in comparison with, for example, regions B–D and region G cannot display very much information because of the limited area, the predetermined illumination time period for this region may be increased to reflect the priority of an event that involves the display of information in this region of the display 5.

In another example, if only a small amount of information having a low associated priority was displayed in one of the larger regions of the display 5, such as region B, C or D shown in FIGS. 3A and 3B, the illumination time period could be reduced to reflect the priority of the event and thus reduced battery power consumption. For example, if only a small amount of text, such as the time, was displayed in central region D, which did not require the predetermined illumination time period X of 10 seconds to view the information, the illumination time period could be decreased to, for example, 3 seconds. In this example, the priority may be associated with the event of a key press, which may occur in order to view the time.

According to another embodiment of the present invention, the brightness of the illumination provided by the illumination elements 27 may depend on the priority associated with each event. The level of brightness associated with each priority for each event may be stored in the mapping table 37. For example, an event with a higher priority, such as an alarm/reminder icon, may be selectively illuminated with a full brightness of the illumination elements 27. By comparison, an event with a lower priority, such as a received text message, may be selectively illuminated with some fraction of full brightness, such as half brightness.

The present invention thus provides a solution to the problem of inefficient illumination of displays of portable electronic devices in that when information to be viewed does not occupy the entire region of the display, the region of the display comprising the information can be selectively illuminated. The present invention therefore overcomes the shortcomings of the prior art by only illuminating the region of the display comprising the information to be viewed and doesn't unnecessarily illuminate regions of the display that do not comprise information, which results in reduced battery power consumption. Another benefit of selective illumination of the regions of the display comprising information is that a user's attention is drawn to the information of interest.

Furthermore, the present invention provides for the illumination time period for different regions of the display to be tailored to the time required to view the information displayed in the respective regions. Regions of a larger size may comprise more information and may therefore be illuminated for longer periods than smaller regions, which are only capable of displaying a smaller amount of information. Hence, regions of the display are not illuminated for unnecessary periods of time resulting in reduced battery power consumption.

A yet further advantage of the context sensitive illumination methods of the present invention is that illumination time periods may be modified depending on a priority of each event. Events with a higher associated priority may be illuminated for longer time periods than events with a lower priority to ensure that the higher priority event information is illuminated for a sufficient period. Hence, higher priority events that may be displayed and selectively illuminated in smaller regions of the display in accordance with one embodiment of the present invention may be provided with a longer illumination period than is otherwise predetermined for that region. Although a longer predetermined illumination time period may be provided in this embodiment, reduced battery power consumption over the prior art is still achieved because a region of the display, rather than the entire area of the display, is selectively illuminated.

Furthermore, the present invention enables the illumination brightness to be dependent on the priority associated with each event. Higher priority events may be selectively illuminated more brightly than lower priority events, thus providing a yet further method of reduced battery power consumption in portable electronic devices.

The present invention is particularly suited to reduced battery power consumption in portable electronic devices that comprise large color displays that require multiple illumination elements such as LEDs for backlighting. However, it will be appreciated that the present invention is not limited to backlighting LCDs or to displays that are backlit with LEDs. The present invention may be used with other types of display and with alternative illumination elements. Furthermore, the present invention is not limited to the predetermined illumination time periods specified in, for example, mapping table 37 of FIG. 4 and alternative predetermined illumination time periods may be employed. Similarly, the present invention is not limited to the number of illumination elements 27 employed for illuminating the display, or to the particular regions (B–L) that are selectively illuminated. It is envisaged that an alternative number of illuminating elements and alternative regions may be employed.

Throughout the specification the aim has been to describe the invention without limiting the invention to any one embodiment or specific collection of features. Persons skilled in the relevant art may realize variations from the specific embodiments that will nonetheless fall within the scope of the invention. For example, the selective illumination of the regions of the display may not be constant for the entire predetermined illumination time period. The illumination elements may be alternated between an activated stated and a deactivated state or a partially activated state to produce flashing selective illumination of the region. Such illumination provides yet further reduced battery power consumption because the illumination elements are activated for a shorter time period. Furthermore, a viewer's attention is more readily drawn to a region that is illuminated by flashing illumination than to a region that is constantly illuminated for the predetermined time period.

The invention claimed is:

1. A method for selectively illuminating regions of a display of a portable electronic device, the display comprising a plurality of illuminating regions, said method including:

detecting an event, to be displayed on the screen, that will trigger an update of said display and activation of illumination elements for illuminating said display;

determining at least one region, from said regions, that require illuminating during said update;

determining an illumination time period that varies dependent on a size of said at least one region that requires illuminating; and selectively illuminating said at least one region of said display for said predetermined illumination time period.

2. The method of claim 1, wherein said determining includes referring to a mapping table to determine said illumination elements to be activated to selectively illuminate said region of said display.

3. The method of claim 1, wherein said predetermined illumination time period depends on a location of said at least one region in said display.

4. The method of claim 1, wherein smaller regions are illuminated for shorter predetermined time periods than larger regions.

5. The method of claim 1, wherein the predetermined illumination time period is also dependent on a priority of said event.

6. The method of claim 1, wherein the step of selectively illuminating said region of said display includes activating one or more of said illumination elements adjacent at least one side of said display to illuminate a side at least one region of said display.

7. The method of claim 1, wherein the step of selectively illuminating said region of said display includes activating one or more of said illumination elements adjacent opposing sides of said display to illuminate a substantially central region of said display.

8. The method of claim 1, wherein the step of selectively illuminating said at least one region includes activating a selected combination of said illumination elements.

9. The method of claim 1, wherein the step of selectively illuminating said at least one region includes activating said illumination elements illuminating said at least one region to a first brightness and activating a remainder of said illumination elements to a second brightness.

10. The method of claim 1, wherein the step of selectively illuminating said at least one region includes one or more of said illumination elements alternating between an activated state and a deactivated or partially activated state to produce flashing illumination.

11. The method of claim 1, wherein the larger the area of said at least one region that requires illuminating, the longer the time period of illumination.

12. A portable electronic device comprising:

a display for displaying information;

a plurality of illumination elements located adjacent said display for illuminating said display;

a display handling module coupled to said display for:

i) updating said display in response to said device detecting an event, to be displayed on the screen, the event triggering an update of said display and activation of said illumination elements; and ii) determining a region of said display in which said information will be displayed during said update, wherein said determining includes identifying an illumination time period that varies dependent on a size of said region; and, an illumination control module coupled to said display handling module for controlling selective illumination of said region for said predetermined illumination time period.

13. The portable electronic device of claim 12, further comprising an illumination driver coupled to said illumination control module and to said illumination elements for controlling activation and deactivation of said illumination elements in response to signals from said illumination control module.

14. The portable electronic device of claim 12, wherein said mapping table comprising identities of said illumination elements to be activated to selectively illuminate said region.

15. The portable electronic device of claim 12, wherein said identifying includes referring to a mapping table comprising a priority associated with each said event and an illumination time period associated with each said priority.

16. The portable electronic device of claim 12, wherein said mapping table has a predetermined illumination brightness value associated with a priority of each said event.

17. A method for selectively illuminating regions of a display of a portable electronic device, the display comprising a plurality of illuminating regions, said method including:

detecting an event, to be displayed on the screen, that will trigger an update of said display and activation of illumination elements for illuminating said display;

determining at least one region, from said regions, that require illuminating during said update;

determining an illumination time period that varies dependent on a size of said region; and selectively applying an illumination brightness in accordance with said priority of said event to provide for illuminating said region of said display for said predetermined illumination time period.

18. The method of claim 17, wherein said determining includes referring to the mapping table to determine said illumination elements to be activated to selectively illuminate said region of said display.

19. The method of claim 17, wherein smaller regions are illuminated for shorter predetermined time periods than larger regions.

20. The method of claim 17, wherein the predetermined illumination rime period is also dependent on a priority of said event.

21. The method of claim 17, wherein the step of selectively illuminating said region of said display includes activating one or more of said illumination elements adjacent at least one side of said display to illuminate a side region of said display.

22. The method of claim 17, wherein the step of selectively illuminating said region includes activating said illumination elements illuminating said region to a first brightness and activating a remainder of said illumination elements to a second brightness.

* * * * *